US007438434B2

(12) United States Patent
Prince, Jr. et al.

(10) Patent No.: US 7,438,434 B2
(45) Date of Patent: Oct. 21, 2008

(54) ILLUMINATED SUPPORT STRUCTURE

(76) Inventors: Richard Prince, Jr., 7705 W. Center St., #1, Milwaukee, WI (US) 53222; Richard Prince, Sr., 7705 W. Center St., #1, Milwaukee, WI (US) 53222

( * ) Notice: Subject to any disclaimer, the term of this patent is extended or adjusted under 35 U.S.C. 154(b) by 0 days.

(21) Appl. No.: 11/416,964

(22) Filed: May 3, 2006

(65) Prior Publication Data

US 2007/0258232 A1 Nov. 8, 2007

(51) Int. Cl.
*F21S 8/00* (2006.01)

(52) U.S. Cl. ..... 362/152; 362/145

(58) Field of Classification Search ..... 362/145, 362/146, 152, 276, 431; 256/10, 19, 59, 256/65.01

See application file for complete search history.

(56) References Cited

U.S. PATENT DOCUMENTS

| | | | | |
|---|---|---|---|---|
| 2,310,593 | A * | 2/1943 | Orlicki | 362/146 |
| 2,479,500 | A | 8/1949 | Longberg | |
| 2,691,718 | A | 10/1954 | Bowers | |
| 3,544,782 | A | 12/1970 | Hahn | |
| 4,232,465 | A | 11/1980 | Stoddard | |
| 4,422,719 | A | 12/1983 | Orcutt | |
| 5,006,967 | A | 4/1991 | Diamond | |
| 5,160,202 | A | 11/1992 | Legare | |
| 5,876,021 | A * | 3/1999 | Spence et al. | 256/65.01 |
| 5,887,856 | A | 3/1999 | Everly, II | |
| 6,065,852 | A | 5/2000 | Crumley | |
| 6,065,853 | A | 5/2000 | Crevier | |
| 6,183,104 | B1 | 2/2001 | Ferrara | |
| 6,301,418 | B1 | 10/2001 | Freier et al. | |
| 6,425,676 | B1 | 7/2002 | Lyons | |
| 6,457,847 | B1 | 10/2002 | LeVasseur | |
| 6,474,858 | B1 | 11/2002 | Liao | |
| 6,505,950 | B1 * | 1/2003 | Natoli et al. | 362/146 |
| 6,565,236 | B1 | 5/2003 | Davis, Jr. | |
| 6,568,827 | B2 | 5/2003 | Forster | |
| 6,606,439 | B2 | 8/2003 | Nojiri et al. | |
| 6,629,772 | B2 | 10/2003 | Brunfeld | |
| 6,712,494 | B1 | 3/2004 | Hodge | |
| 6,883,949 | B2 | 4/2005 | Goto et al. | |
| 2003/0079387 | A1 | 5/2003 | Derose | |
| 2007/0279898 | A1 * | 12/2007 | Sheridan | 362/152 |

FOREIGN PATENT DOCUMENTS

FR 2691522 A1 * 11/1993

* cited by examiner

*Primary Examiner*—Y. My Quach-Lee

(57) ABSTRACT

An illuminated support structure comprised of: a first and second vertical post; a top rail and bottom rail positioned between the posts; a plurality of spindles positioned at intervals between the and bottom rails and capable of providing intervals of unlit areas between each spindle; at least one light source for each spindle; and a power source to provide power to each of said at least one light source.

26 Claims, 3 Drawing Sheets

ILLUMINATED SUPPORT STRUCTURE

FIELD OF THE INVENTION

This invention relates generally to the field of support structures and specifically to support structures that can be illuminated.

DETAILED DESCRIPTION OF EMBODIMENTS OF THE INVENTION

Figure 1:
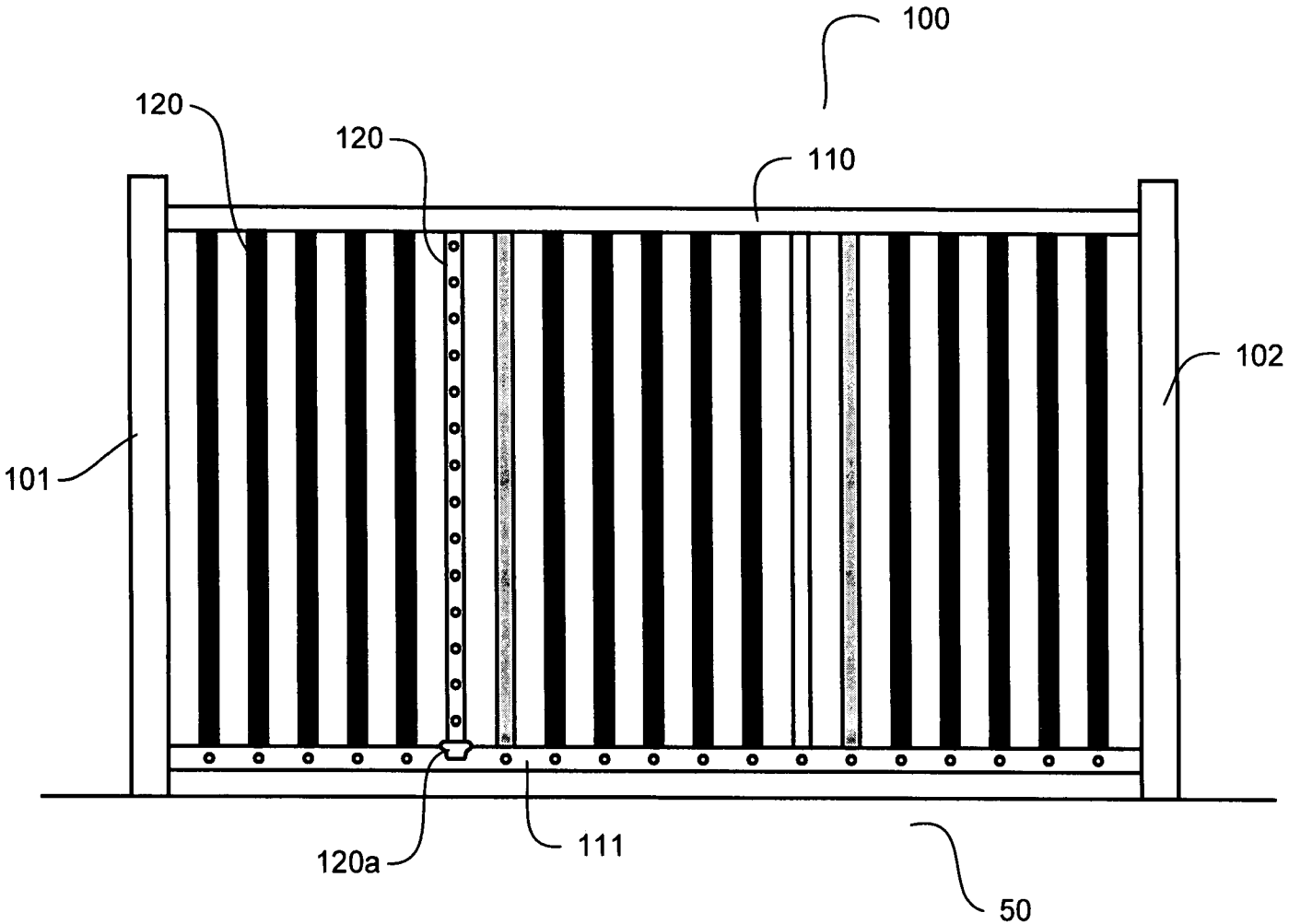
FIG. 1 is a front view of one embodiment of one section of an illuminated support structure.

The drawings include exemplary embodiments to the invention, which may be embodied in various forms. It is to be understood that in some instances various aspects of the invention may be shown exaggerated or enlarged to facilitate an understanding of the invention. Furthermore, with reference to the drawings, the reader should understand that like reference numerals in different drawings refer to the like elements and components of the invention. Moreover, it should be noted that each embodiment of the invention is not depicted by the figures.

Detailed descriptions of the embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

FIG. 1 is a front view of one embodiment of one section of an illuminated support structure 100 used as a hand railing. The representative section of FIG. 1 has two support posts 101, 102, each secured to a lower surface 50 and connected by top rail 110 and bottom rail 111. Support posts 101, 102 are substantially vertical, and top rail 110 and bottom rail 111 are substantially horizontal. Positioned between top rail 110 and bottom rail 111, is a series of spindles 120 (as discussed in greater detail with respect to FIG. 3). In the embodiment shown, spindles 120 are spaced at six inch (6") intervals. However, spindles 120 can be spaced at alternate intervals, as discussed in greater detail infra. Also in the embodiment shown, a light source (102*a*) is positioned at the bottom of each spindle 120. However, the light sources may be positioned at the top or at any point on spindle 120. Each light source is connected to a power source. In the embodiment shown, each light source is connected to one another in the series and connected to a single power source. However, multiple sources can be used. In addition, the power source may be electrically connected to the light source by wires running through posts 101, 102, top rail 110, bottom rail 111, or any individual spindle 120. The amount of light emitted from spindles 120 and the light source retain the visual effect of vertically lit structures with unlit intervals between 120.

In the embodiment shown, top rail 110 and bottom rail 111 are horizontally positioned between posts 101, 102. However, top rail 110 and bottom rail 111 could alternately be angled at any angle between posts 102, 102 where, for example, post 101 is positioned at or near the top of a stairway and post 102 is positioned at or near the bottom of a stairway. Top rail 110 and bottom rail 111 would then be positioned at an angle generally parallel to the incline of the stairway.

In one embodiment, the light source is sufficient to illuminate the surrounding area yet maintains an appearance of intervals darkness between each spindle.

Posts 101, 102 are made of any sufficiently durable material capable of functioning as support. For those embodiments of illuminated support structure 100 in which the electrical wires enter illuminated support structure 100 through posts 101, 102, posts 101, 102 should be made of a sufficiently durable material capable of maintaining its support characteristics when molded or formed into a structure to accommodate insertion of wiring from an electrical source. In the embodiment shown, posts 101, 102 are made of wood, but alternately can be made of metal, plastic, acyclic polycarbon hydrocarbyl, stone, concrete, plaster, and combinations thereof.

Each spindle 120 is made of durable, rigid and completely or partly transparent material capable of transmitting light and maintaining a shape when formed into a hollow structure to the transmission of light along the length of each spindle 120. However, in other embodiments of the invention, light may be emitted solely through apertures in spindle 120. In the embodiment shown, spindle 120 is made of plastic, but alternatively can be made of another plastic (clear or partially opaque), resin, acyclic polycarbon hydrocarbyl, or any material through which light can pass or made of any material permitting the creation of apertures permitting light to pass through. The light source may also be positioned at the top or at any other point along the length of spindle 120. In alternate embodiments of illuminated support structure 100, the light source may be positioned at the top of spindle 120 and within top rail 110, at any other point along spindle 120, or may be at multiple positions above, below, and/or within spindle 120.

In the embodiment shown in FIG. 1, spindles 120 are clear and cylindrically shaped. However, spindles could be any color, tint or level of transparency and of any regular or irregular shape or configuration. Spindles 120 may be solid or have apertures.

The embodiment of the illuminated support structure 100 is ten feet (10') in length and thirty-six inches (36") high, with two posts 101, 102, and nineteen spindles 120 spaced at least six inches (6") apart. However, it should be understood that spindles 120 could be spaced at other intervals, both less than and greater than the six inch (6") intervals shown in the embodiment of FIG. 1, and that spindles 120 could be evenly or irregularly spaced apart from one another. One of ordinary skill in the art will further recognize that other dimensions of illuminated support structure 100, alternative number of posts 101, 102 and alternate configurations of spindles 120 could be employed, including configurations where spindles 120 are arranged in directions other than vertically, and configurations where spindles 120 are irregularly spaced.

Figure 2:
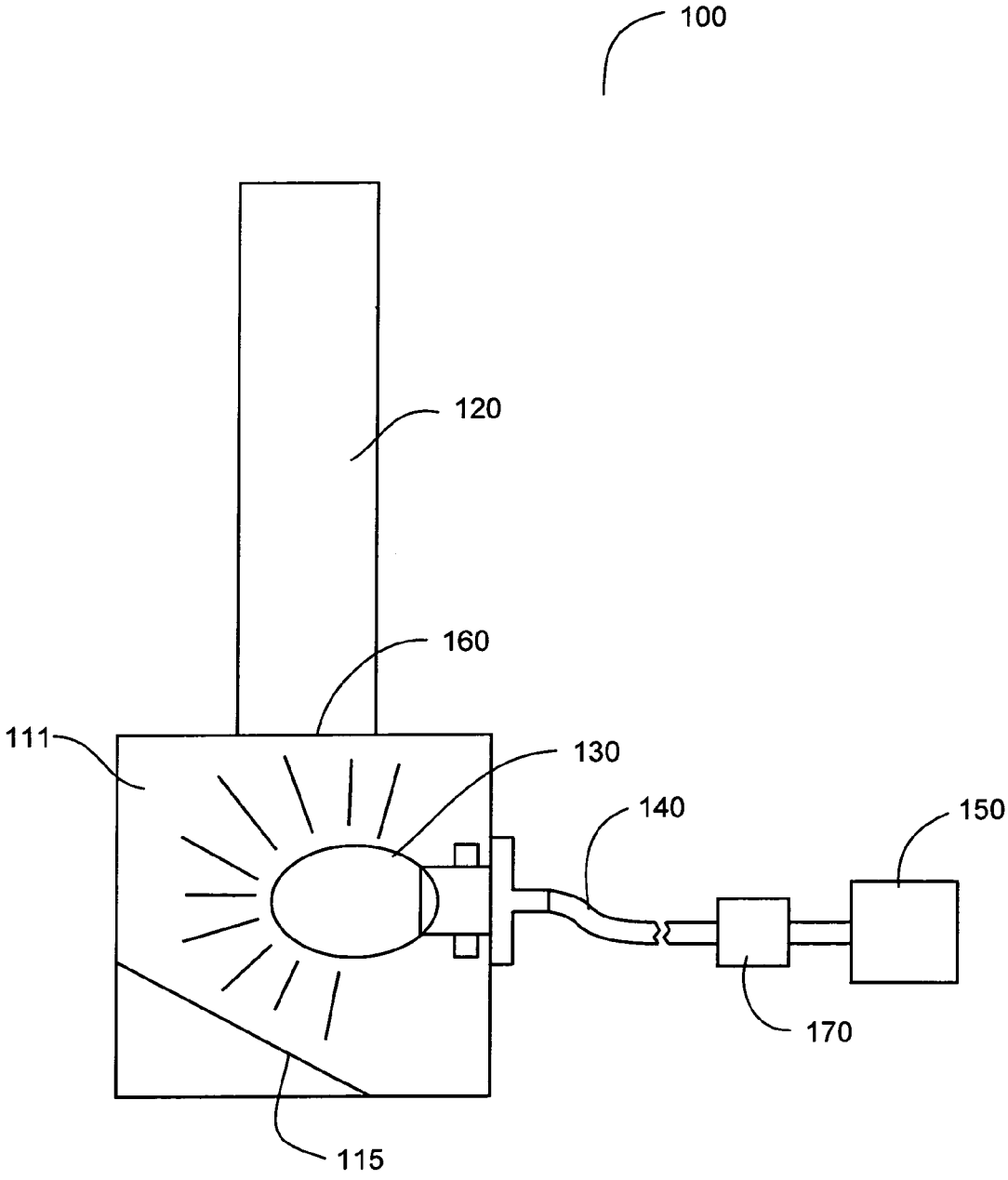
FIG. 2 is a cross-sectional view of one embodiment of a spindle and a portion of the bottom rail.

FIG. 2 is a cross-sectional view of the embodiment of spindle 120 and bottom rail 111 shown in FIG. 1. In this embodiment light source 130 is positioned within bottom rail 111 and connected to power source 150 by wire 140. However, light source 130 can be positioned at any point within rail 111 or within spindle 120. Also visible in FIG. 2 is aperture 160, which permits light emitted from light source 130 to enter spindle 120 and be visible from illuminated support structure 100.

Visible in FIG. 2 is light source 130. In this embodiment light source 130 is an incandescent light bulb without pigment. However other embodiments of light source 130 can include fluorescent light, LED, bug repellent lighting, fiber optic, tinted or colored lighting, energy efficient lighting or any other device capable of emitting or reflecting light, including reflective tape or particles of a reflective substance.

Also visible in FIG. 2 is reflective surface 115 positioned below light source 130 to enhance the illuminating feature of illuminated support structure 100. One of ordinary skill in the art will recognize that reflective surface 115 could be in alternate positions or alternate configurations, including an embodiment of illuminated support structure 100 without a reflective surface. There may also be multiple reflective surfaces, including particles of a substance capable of being reflective. The reflective surface or surfaces may be positioned at any angle.

Power source 150 is in the embodiment shown, an AC power source. An alternate embodiment power source may be a DC power source, Uninterruptible Power Supply (UPS), battery, solar power, hydro-electric power, all types of generators or any other power source capable of delivering power to light source 130.

Also shown in FIG. 2 is control device 170 which permits power source 150 to be turned on and off, and permits control, synchronization or timed use of light sources 130 or groups of light sources 130. Control device 170 may utilize computer code, remote access technology or other technology to coordinate, control or time the functioning of individual light sources 130 or groups of light sources 130. Yet another embodiment does not include control device 150.

Figure 3:
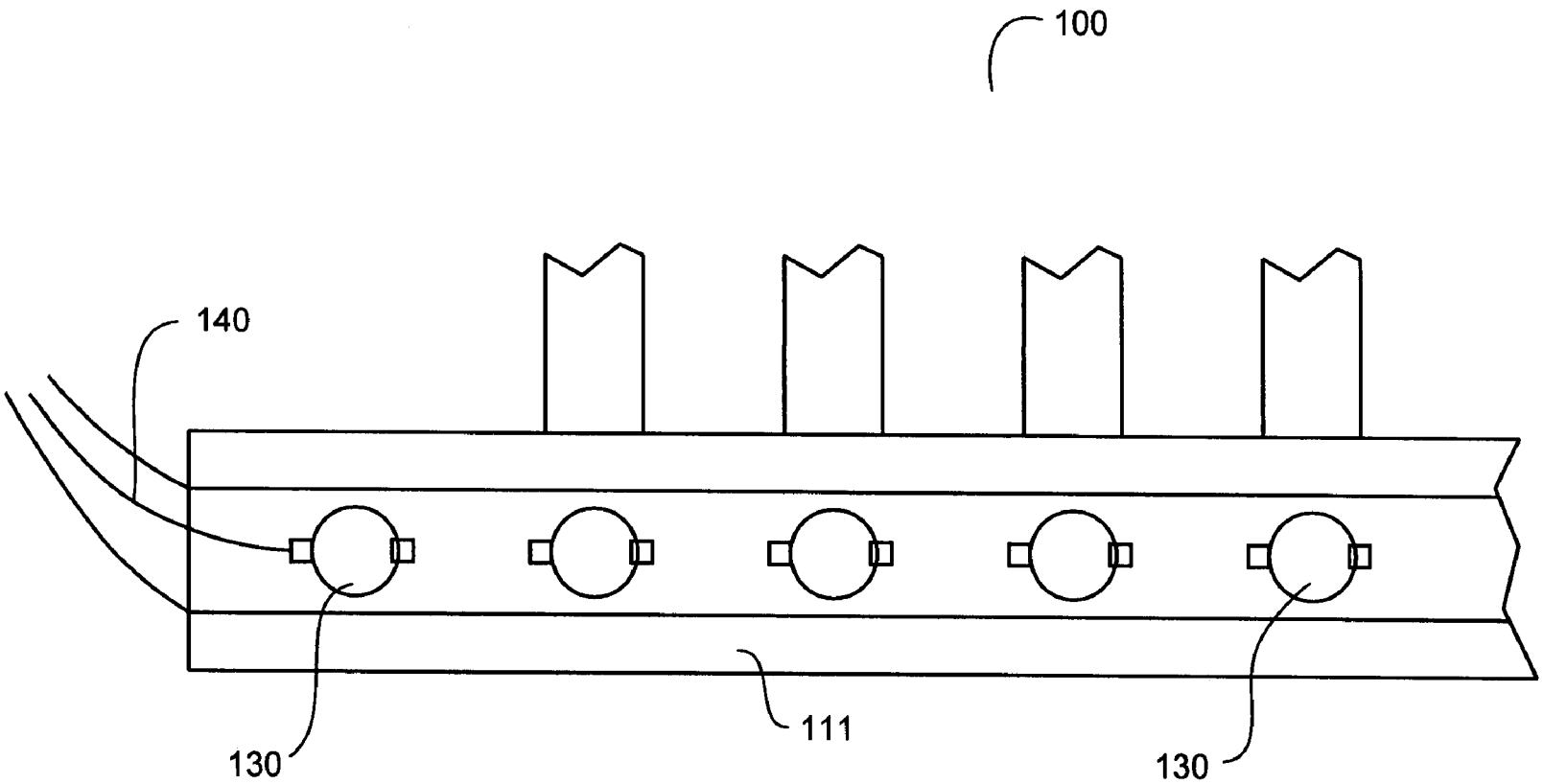
FIG. 3 is a top cross-sectional view of one embodiment of the bottom rail.

FIG. 3 is a top cross-sectional view of one embodiment of bottom rail 111 showing light sources 130 electrically connected in series and positioned within bottom rail 111.

While several embodiments of the present invention have been shown and described, it is to be understood that the invention is not limited thereto, but is susceptible to numerous changes and modifications as known to a person skilled in the art, and it is intended that the present invention not be limited to the details shown and described herein, but rather cover all such changes and modifications as are obvious to one of ordinary skill in the art.

What is claimed is:

1. An illuminated support structure comprised of:

a first vertical post and a second vertical post;

a top rail and a bottom rail substantially horizontally disposed between said first post and said second post;

a plurality of substantially vertical spindles collectively supporting said top rail and positioned at intervals between said top rail and said bottom rail, each of said plurality of substantially vertical spindles positioned between said first vertical post and said second vertical post and capable of providing intervals of unlit areas between each of said plurality of substantially vertical spindles, wherein each of said plurality of substantially vertical spindles has an inner chamber and outer surface and is made of an at least partially transparent material; and at least one light source for each of said plurality of substantially vertical spindles, at least one of said at least one light source positioned within one of said plurality of substantially vertical spindles, said at least one light source capable of illuminating said inner chamber of one of said plurality of substantially vertical spindles with the light passing through the spindle and emitting outward from the spindle so the light can be viewed through substantially all of said outer surface of at least one of said plurality of substantially vertical spindles, said structure adapted to be electrically connected to a power source to provide power to each of said at least one light source.

2. The structure of claim 1, wherein said first vertical post, said second vertical post, said top rail, and said bottom rail are made of a material selected from a group consisting of wood, metal, plastic, acyclic polycarbon hydrocarbyl, stone, fiberglass, resin, concrete, plaster, and combinations thereof.

3. The structure of claim 1, wherein said at least partially transparent material is selected from a group consisting of plastic, resin, acyclic polycarbon hydrocarbyl, and combinations thereof.

4. The structure of claim 3, wherein each of said plurality of substantially vertical spindles is colored or tinted.

5. The structure of claim 1, wherein each of said plurality of substantially vertical spindles further includes at least one aperture to permit transmission of light therethrough.

6. The structure of claim 1, wherein said structure further includes a control device, said control device controlling actions selected from a group consisting of an on/off function, synchronization of more than one light source, and timed use of said at least one light source.

7. The structure of claim 1, wherein said at least one light source is selected from a group consisting of a fluorescent light, an LED, bug repellent lighting, fiber optic, tinted lighting, colored lighting, energy efficient lighting, and combinations thereof.

8. The structure of claim 1, wherein said power source is selected from a group consisting of an AC power source, a DC power source, an Uninterruptible Power Supply, a battery, solar power, hydro-electric power, and combinations thereof.

9. The structure of claim 1, wherein said illuminated support structure provides general illumination of an area surrounding said illuminated support structure.

10. An illuminated support structure comprised of:

a first vertical post and a second vertical post;

a top rail and a bottom rail, substantially horizontally disposed between said first post and said second post;

a plurality of substantially vertical spindles collectively supporting said top rail and positioned at intervals between said top rail and said bottom rail, wherein each of said plurality of substantially vertical spindles has an inner chamber and an outer surface and is made of an at least partially transparent material;

at least one light source for each of said plurality of substantially vertical spindles, at least one of said at least one light source positioned within one of said plurality of substantially vertical spindles, said at least one light source capable of illuminating said inner chamber of one of said plurality of substantially vertical spindles with the light passing through the spindle and emitting outward from the spindle so that light can be viewed through substantially all of said outer surface of at least one of said plurality of substantially vertical spindles; and a power source to provide power to each of said at least one light source;

said illuminated support structure capable of providing general illumination of an area surrounding said illumination support structure.

11. The structure of claim 10, wherein said first vertical post, said second vertical post, said top rail, and said bottom rail are made of a material selected from a group consisting of wood, metal, acyclic polycarbon hydrocarbyl, stone, concrete, plaster, fiberglass, resin, and combinations thereof.

12. The structure of claim 10, wherein each of said plurality said at least partially material is selected from a group consisting of plastic, resin, acyclic polycarbon hydrocarbyl, and combinations thereof.

13. The structure of claim 10, wherein each of said plurality of substantially vertical spindles is colored or tinted.

14. The structure of claim 10, wherein each of said plurality of substantially vertical spindles further includes at least one aperture to permit transmission of light therethrough.

15. The structure of claim 10, wherein each of said plurality of substantially vertical spindles is capable of providing intervals of unlit areas between each of said plurality of substantially vertical spindles.

16. The structure of claim 10, wherein said structure further includes a control device, said control device controlling actions selected from a group consisting of an on/off function, synchronization of mare than one light source, and timed use of said at least one light source.

17. The structure of claim 10, wherein said at least one light source is selected from a group consisting of a fluorescent light, an LED, bug repellent lighting, fiber optic, tinted lighting, colored lighting, energy efficient lighting, and combinations thereof.

18. The structure of claim 10, wherein said power source is selected from a group consisting of an AC power source, a DC power source, an Uninterruptible Power Supply, a battery, solar power, hydro-electric power, and combinations thereof.

19. An illuminated support structure comprised of:

a first vertical post and a second vertical post;

a top rail and a bottom rail, disposed between said first post and said second post;

a plurality of substantially vertical spindles of collectively supporting said top rail and positioned between said top rail and said bottom rail and between said first vertical post and said second vertical post, and capable of providing intervals of unlit areas between each of said plurality of substantially vertical spindles and each providing support to said top rail, wherein each of said plurality of substantially vertical spindles has an inner chamber and an outer surface and is made of an at least partially transparent material; and at least one light source for each of said plurality of substantially vertical spindles, at least one of said at least one light source positioned within one of said plurality of substantially vertical spindles, said at least one light source capable of illuminating said inner chamber of one of said plurality of substantially vertical spindles with the light passing through the spindle and emitting outward from the spindle so that light can be viewed through substantially all of said outer surface of at least one of said plurality of substantially vertical spindles, said structure adapted to be electrically connected to a power source to provide power to each of said at least one light source and capable of providing general illumination of an area surrounding said illuminated support structure.

20. The structure of claim 19, wherein said first vertical post, said second vertical post, said top rail, and said bottom rail are made of a material selected from a group comprised consisting of wood, metal, plastic, acyclic polycarbon hydrocarbyl, stone, concrete, plaster, fiberglass, resin, and combinations thereof.

21. The structure of claim 19, wherein said at least partially transparent material is selected from a group consisting of plastic, resin, acyclic polycarbon hydrocarbyl, and combinations thereof.

22. The structure of claim 19, wherein each of said plurality of substantially vertical spindles is colored or tinted.

23. The structure of claim 19, wherein each of said plurality of substantially vertical spindles further includes at least one aperture to permit transmission of light therethrough.

24. The structure of claim 19, wherein said structure further includes a control device, said control device controlling actions selected from a group consisting of an on/off function, synchronization of said at least one light source, and timed use of said at least one light source.

25. The structure of claim 19, wherein said at least one light source is selected from a group consisting of a fluorescent light, an LED, bug repellent lighting, fiber optic, tinted lighting, colored lighting, energy efficient lighting, and combinations thereof.

26. The structure of claim 19, wherein said power source is selected from a group consisting of an AC power source, a DC power source, an Uninterruptible Power Supply, a battery, solar power, hydro-electric power, and combinations thereof.

* * * * *